US006478075B1

(12) United States Patent
Shibata et al.

(10) Patent No.: US 6,478,075 B1
(45) Date of Patent: Nov. 12, 2002

(54) DIE-CASTING METHOD AND DIE-CASTINGS OBTAINED THEREBY

(75) Inventors: Ryoichi Shibata, Tochigi-ken (JP); Takeo Kaneuchi, Saitamaken (JP)

(73) Assignee: Hitachi Metals, Ltd., Tokyo (JP)

( * ) Notice: Subject to any disclaimer, the term of this patent is extended or adjusted under 35 U.S.C. 154(b) by 0 days.

(21) Appl. No.: 09/446,961

(22) PCT Filed: Jun. 30, 1998

(86) PCT No.: PCT/JP98/02923

§ 371 (c)(1),
(2), (4) Date: Dec. 30, 1999

(87) PCT Pub. No.: WO99/00203

PCT Pub. Date: Jan. 7, 1999

(30) Foreign Application Priority Data

Jun. 30, 1997 (JP) ..... 9-173355

(51) Int. Cl.[7] ..... B22D 27/09; B22D 17/10

(52) U.S. Cl. ..... 164/113; 164/66.1; 164/485; 164/900

(58) Field of Search ..... 164/113, 312, 164/66.1, 68.1, 261, 63, 485, 900

(56) References Cited

U.S. PATENT DOCUMENTS 4,633,930 A * 1/1987 Behrens ..... 164/66.1
5,579,825 A * 12/1996 Shibata et al. ..... 164/493

FOREIGN PATENT DOCUMENTS

EP 0 733 421 A * 9/1996
JP 7-155927 6/1995 ..... B22D/17/32
JP 08150459 A * 6/1996
JP 8-150459 6/1996 ..... B22D/17/30
JP 8-257722 10/1996 ..... B22D/17/00
JP 9-1316 * 1/1997
JP 9-66350 * 3/1997
JP 9-85418 3/1997 ..... B22D/17/32

* cited by examiner

*Primary Examiner*—M. Alexandra Elve
*Assistant Examiner*—Len Tran
(74) *Attorney, Agent, or Firm*—Sughrue Mion, PLLC

(57) ABSTRACT

A die casting method and a casting that is obtained through use of the die casting method. The die casting method can solve problems such as air catching occurring at the time of injection into the cavity of a die and molten metal run defect, thereby enabling efficient production of defect-free perfect castings. Via a mouth piece 7 and a molten-metal feed port 4, molten metal from a molten metal feeder flows into a casting sleeve 2 while undergoing laminar flow. When the molten metal reaches a predetermined level, a plunger tip 5 is moved upward within the casting sleeve 2 and stops at a position where the side surface of the plunger tip 5 closes the molten-metal feed port 4. The molten metal that has flowed into the casting sleeve 2 is cooled by a cooling medium flowing through passages 2*b* formed within the casting sleeve 2 so that said molten metal forms primary crystals. Simultaneously, through use of a high frequency coil 6, the molten metal is subjected to electromagnetic agitation. As a result, the molten metal is fluidized and soaked. At this time, the temperature of the molten metal is detected by a sensor. When it is judged that the solid phase ratio has reached an arbitrary value in the range of 10–60%, the plunger tip 5 is moved upward in order to inject the semi-solidified molten metal into the cavity of a die 1.

16 Claims, 9 Drawing Sheets

DIE-CASTING METHOD AND DIE-CASTINGS OBTAINED THEREBY

TECHNICAL FIELD

The present invention relates to a die casting method and apparatus for manufacturing high quality castings having excellent mechanical properties.

BACKGROUND ART

As is well known, a die casting method is a casting method in which molten metal within a casting sleeve is pressure-charged into the cavity of a die and is solidified to thereby manufacture a casting.

The die casting method has advantages that obtained castings have high dimensional accuracy, mass production is possible because the method allows high speed operation, and fully automatic operation is possible through use of a computer. Therefore, the die casting method is frequently used for casting of low-melting-point metals such as aluminum alloys.

However, there have been pointed out the following problems in relation to the die casting method.

A first problem relates to strength. That is, unless a casting obtained through use of the die casting is subjected to reforming such as heat treatment, the casting is generally inapplicable to high-strength members that must have high strength. The reason for this is as follows.

In general, when die casting is performed, molten metal poured into the casting sleeve is rapidly cooled by means of the inner wall of the casting sleeve, and thus solidification scale is generated. Since the solidification scale is cast together with said molten metal, the resultant product contains the solidification scale, resulting in a decrease in the mechanical strength of the product.

Further, when molten metal is injected from the sleeve into a die, air within the casting sleeve becomes caught in said molten metal and is mixed into a resultant casting. In this case, when the casting is heat-treated, swelling called a blister is generated, which becomes a cause of deterioration of quality.

In order to solve the above-described problems of the die casting method, various types of special die casting methods have been proposed. Among them, a hot sleeve method is a die casting method in which casting is performed while a casting sleeve is heated in order to prevent generation of solidification scale at the inner wall of the casting sleeve.

Also, a vertical-injection die casting method is performed in order to suppress catching of air within the casting sleeve.

However, the above-described various types of special die casting methods have the following problems to be solved.

That is, when the speed of injection from a casting sleeve into a die cavity is increased in order to enhance productivity, molten metal within the casing sleeve undergoes turbulent flow, so that the amount of air caught in said molten metal increases, and in addition solidification scale that is produced by rapid cooling and solidification of molten metal at the inner surface of the die is taken into a product. This causes deterioration of the mechanical properties of the obtained product.

Meanwhile, when molten metal is injected from the casting sleeve into the die cavity at a slow speed in order to prevent catching of air, run of molten metal within the die cavity becomes poor, which becomes a cause of a product defect such as misrun.

Japanese Patent Application Laid-Open No. 8-257722 discloses a die casting method that attempts to solve the above-described problems involved in the various kinds of conventional special die casting methods.

In the die casting method disclosed in Japanese Patent Application Laid-Open No. 8-257722, primary crystals of molten metal are granulated within a casting sleeve, charged under pressure into the cavity of a die in a semi-molten state, and solidified therein. According to the die casting method disclosed in Japanese Patent Application Laid-Open No. 8-257722, die casting is performed in the steps described below.

First, as shown in FIG. 8, molten metal maintained at a temperature near the liquidus line is poured into a casting sleeve 2. Subsequently, as shown in FIG. 8, the temperature of said molten metal within the casting sleeve 2 is decreased at a predetermined cooling rate, from the temperature near the liquidus line to a predetermined temperature that is below the liquidus line but higher than the solidus line or eutectic line, in order to substantially granulate primary crystals of said molten metal, thereby bringing said molten metal into a semi-molten state. With this operation, there can be obtained thixotropic fluid composed of granular primary crystals and liquid having a temperature not less than the eutectic temperature.

Subsequently, as shown in FIG. 8, the semi-molten metal is charged from the casting sleeve 2 into a die 1. At this time, the semi-molten metal charged from the casting sleeve 2 into the die 1 undergoes laminar flow due to its thixotropy, so that the amount of gas caught in the semi-molten metal decreases. That is, when the metallographic structure is granulated with resultant formation of a solid phase, even if some force would be added, movement of the granulated solid phase and movement of the liquid phase occur simultaneously, so that there occurs a phenomenon in which the solid and liquid phases move together. As a result, catching of gas occurs to a lesser extent, and therefore the amount of gas contained in a casting decreases with the result that blisters are not generated even when heat treatment is performed.

However, the die casting method disclosed in Japanese Patent Application Laid-Open No. 8-257722 has the following drawbacks that must be overcome.

In the die casting method disclosed in Japanese Patent Application Laid-Open No. 8-257722, as shown in FIG. 8, molten metal is poured into the casting sleeve 2 from above through use of a ladle or the like. Therefore, when said molten metal falls into the interior of the sleeve 2, it undergoes turbulent flow within the sleeve 2 and air may be caught in said molten metal. In this case, the amount of gas contained in said molten metal increases and oxide film tends to be formed on the surface of said molten metal, so that gas holes are produced. When strict quality control is performed in order to prevent generation of such gas holes, yield decreases. Further, since casting must be controlled in order to prevent oxides produced in said molten metal from being caught in said molten metal, which oxides would otherwise affect the mechanical properties, the production cycle time may increase, and yield may decrease due to strict quality control.

FIG. 9 shows an example of oxide film 30 and a gas hole 31 which decrease the yield of products as a result of performance of strict quality control.

The die casting method of the present invention was accomplished in view of the forgoing problems of prior art techniques, and an object of the present invention is to provide a die casting method which can minimize the amount of air caught in molten metal when fed into a casting sleeve in order to reduce the amount of gas contained in said molten metal to thereby prevent generation of oxide film or gas holes, while solving problems such as air catching occurring at the time of injection into the cavity of the die and molten metal run defect, thereby enabling efficient production of defect-free perfect castings and increasing the yield. Another object of the present invention is to provide die castings obtained through use of the die casting method.

DISCLOSURE OF THE INVENTION

To solve the above-described problems, the present invention provides in a die casting method that after molten metal is fed into a casting sleeve through its side portion, said molten metal is cooled in order to granulate crystallized primary crystals, the die casting method characterized in that said molten metal is fed into a casting sleeve through its side portion in the vicinity of the bottom portion thereof, and an inert gas is supplied near a molten-metal feed port into a molten-metal feed pipe.

In the die casting method of the present invention, primary crystals of molten metal within the casting sleeve are substantially granulated and thus said molten metal is brought into a semi-molten state. Subsequently, said molten metal is charged under pressure into the cavity of a die and solidified. The supply of the inert gas near the molten-metal feed port into the molten-metal feed pipe is performed with the feed of said molten metal into the casting sleeve through its side portion in the vicinity of the bottom portion thereof. Therefore, oxidation of said molten metal in the semi-molten near the molten-metal feed port state occurs to a lesser extent. The feed of said molten metal into the casting sleeve is performed through a side portion of the sleeve near the bottom portion thereof. Therefore, oxidation of said molten metal in the semi-molten state occurs to a lesser extent, so that stable mechanical properties are attained.

Also, the present invention provides in a die casting method that after molten metal is fed into a casting sleeve through its side portion, said molten metal is cooled in order to granulate crystallized primary crystals, the die casting method characterized in that said molten metal is fed into a casting sleeve through a portion that is offset from the center position between the rest position of a plunger tip disposed within the sleeve and a die toward the plunger tip; and an inert gas is supplied near a molten-metal feed port into a molten-metal feed pipe.

In the die casting method of the present invention, primary crystals of molten metal within the casting sleeve are substantially granulated and thus said molten metal is brought into a semi-molten state. Subsequently, said molten metal is charged under pressure into the cavity of a die and solidified. The supply of the inert gas near the molten-metal feed port into the molten-metal feed pipe is performed with the feed of said molten metal into a casting sleeve through a portion that is offset from the center position between the rest position of the plunger tip disposed within the sleeve and the die toward the plunger tip. Therefore, oxidation of said molten metal in the semi-molten near the molten-metal feed port state occurs to a lesser extent. The feed of said molten metal into the casting sleeve is performed through a portion that is offset from the center position between the rest position of the plunger tip and the die toward the plunger tip. Therefore, oxidation of said molten metal in the semi-solidified state occurs to a lesser extent, so that stable mechanical properties are attained.

Further, the present invention provides in a die casting method that after molten metal is fed into a casting sleeve through its side portion, said molten metal is cooled in order to granulate crystallized primary crystals, the die casting method characterized in that said molten metal is fed into a casting sleeve through its side portion in the vicinity of the bottom portion thereof while undergoing laminar flow; and an inert gas is supplied near a molten-metal feed port into a molten-metal feed pipe.

In the die casting method of the present invention, primary crystals of molten metal within the casting sleeve are substantially granulated and thus said molten metal is brought into a semi-molten state. Subsequently said molten metal is charged under pressure into the cavity of a die and solidified. The supply of the inert gas near the molten-metal feed port into the molten-metal feed pipe is performed with the feed of said molten metal into the casting sleeve through its side portion in the vicinity of the bottom portion thereof while undergoing laminar flow. Therefore, oxidation of said molten metal in the semi-molten near the molten-metal feed port state occurs to a lesser extent. The feed of said molten metal into the casting sleeve is performed in a laminar flow state through a side portion of the sleeve near the bottom portion thereof. Therefore, oxidation of said molten metal in the semi-molten state occurs to a lesser extent, so that stable mechanical properties are attained. Especially, since casting is performed while said molten metal undergoes laminar flow, the amount of air caught in molten metal can be reduced compared to the case where casting is performed while said molten metal undergoes turbulent flow. Thus, the amount of oxides and the like contained in castings can be decreased.

Further, the die casting method according to the present invention is characterized in that the rate of cooling molten metal within the sleeve is controlled to be less than 10° C./sec.

When the rate of cooling molten metal within the sleeve is made less than 10° C./sec, produced primary crystals can be granulated. Further, the rate of cooling molten metal within the sleeve is preferably set to be greater than 1.7° C./sec. In this case, productivity can be improved within a range in which produced primary crystals can be granulated.

Specific methods for performing cooling at a cooling rate within a predetermined range are as follows:

(1) The sleeve is formed of a material of low heat conductivity such as ceramics in order to decrease the cooling rate at the surface of the sleeve, thereby making the inside cooling rate less than 10° C./sec. When the inside cooling rate becomes less than 1.7° C./sec, the sleeve cooling system is needed.

(2) When a metallic sleeve is used, the metallic sleeve is heated in advance in order to increase the initial temperature. Especially, in the case of A357 material (having the composition (by weight %) of 6.5–7.5% Si, 0.60% Mg, 0.12% Fe, 0.10% Cu, 0.05% Mn and balance substantially Al), the initial temperature of the sleeve is held at not less than 200° C. When the cooling rate inside said molten metal becomes less than 1.7–10° C./sec, the sleeve is cooled.

(3) A cooling container is formed into a cold crucible structure, and the surface of molten metal is heated through high frequency agitation, so that heat is applied to said molten metal while the container is cooled. Thus, the cooling rate at the surface of said molten metal is controlled, and the inside portion of said molten metal is cooled at a predetermined cooling rate.

In the present invention, the semi-molten metal granulated within the casting sleeve is preferably formed into a spherical shape when the semi-molten metal is charged into the cavity of a die. In this case, since the granules become finer, run of said molten metal is improved.

Further, the die casting method according to the present invention is characterized in that the die casting is performed under control such that the total amount of gas contained in an obtained casting does not exceed about 1 cc/100 g.

As a result of control such that the total amount of gas contained in an obtained casting does not exceed about 1 cc/100 g, there can be obtained a casting whose total amount of gas contained therein is reduced. Further, when the die casting method of the present invention is employed, control of the total amount of gas can be performed quite efficiently.

Further, in the die casting method according to the present invention, the interior of the casting sleeve is made an inert gas atmosphere at least when molten metal is fed into the sleeve. Therefore, generation of gas defects can be prevented. In addition, oxidation of said molten metal can be minimized.

Further, the present invention provides in a die casting obtained such a manner that after molten metal is fed into a casting sleeve through its side portion, said molten metal is cooled in order to granulate crystallized primary crystals, the die casting characterized by being obtained such a manner that said molten metal is fed into a casting sleeve through its side portion in the vicinity of the bottom portion thereof, an inert gas is supplied near a molten-metal feed port into a molten-metal feed pipe; and that control is performed such that the total amount of gas contained in the casting does not exceed about 1 cc/100 g.

The die casting of the present invention that is produced in accordance with the die casting method of the present invention under control such that the total amount of gas contained in the casting does not exceed about 1 cc/100 g is low in cost because there is employed means for supplying the inert gas near the molten-metal feed port into the molten-metal feed pipe and feeding said molten metal into the casting sleeve through its side portion in the vicinity of the bottom portion thereof, and therefore an unduly complicated casting process is not required. Therefore, the die casting has stable mechanical properties because of its reduced total amount of gas.

Further, the present invention provides in a die casting obtained such a manner that after molten metal is fed into a casting sleeve through its side portion, said molten metal is cooled in order to granulate crystallized primary crystals, the die casting characterized by being obtained such a manner that said molten metal is fed into a casting sleeve through a portion that is offset from the center position between the rest position of a plunger tip disposed within the sleeve and a die toward the plunger tip, an inert gas is supplied near a molten-metal feed port into a molten-metal feed pipe; and that control is performed such that the total amount of gas contained in the casting does not exceed about 1 cc/100 g.

The die casting of the present invention that is produced in accordance with the die casting method of the present invention under control such that the total amount of gas contained in the casting does not exceed about 1 cc/100 g is low in cost because there are employed means for supplying the inert gas near the molten-metal feed port into the molten-metal feed pipe and feeding said molten metal into the casting sleeve through a portion that is offset from the center position between the rest position of a plunger tip disposed within the sleeve and the die toward the plunger tip and employed means for feeding molten metal into the casting sleeve through a portion that is offset from the center position between the rest position of the plunger tip and the die toward the plunger tip, and therefore an unduly complicated casting process is not required. In addition, the semi-solidified molten metal undergoes oxidation to a lesser extent, and therefore the die casting has stable mechanical properties.

Further, the present invention provides in a die casting obtained such a manner that after molten metal is fed into a casting sleeve through its side portion, the molten metal is cooled in order to granulate crystallized primary crystals, the die casting characterized by being obtained such a manner that said molten metal is fed into a casting sleeve in a laminar flow state through a side portion in the vicinity of the bottom portion thereof, an inert gas is supplied near a molten-metal feed port into a molten-metal feed pipe; and that control is performed such that the total amount of gas contained in the casting does not exceed about 1 cc/100 g.

The die casting of the present invention that is produced in accordance with the die casting method of the present invention under control such that the total amount of gas contained in an obtained casting does not exceed about 1 cc/100 g is low in cost because there are employed means for supplying the inert gas near the molten-metal feed port into the molten-metal feed pipe and feeding said molten metal into the casting sleeve in a laminar flow state through a side portion in the vicinity of the bottom portion thereof and employed means for feeding molten metal into the casting sleeve in a laminar flow state through a side portion in the vicinity of the bottom portion thereof, and therefore an unduly complicated casting process is not required. In addition, the semi-solidified molten metal undergoes oxidation to a lesser extent, and therefore the die casting has stable mechanical properties. Moreover, since casting is performed while said molten metal undergoes laminar flow, the amount of air caught in molten metal can be reduced. Thus, the amount of oxides contained in the casting can be decreased.

DESCRIPTION OF SYMBOLS

Figure 1:
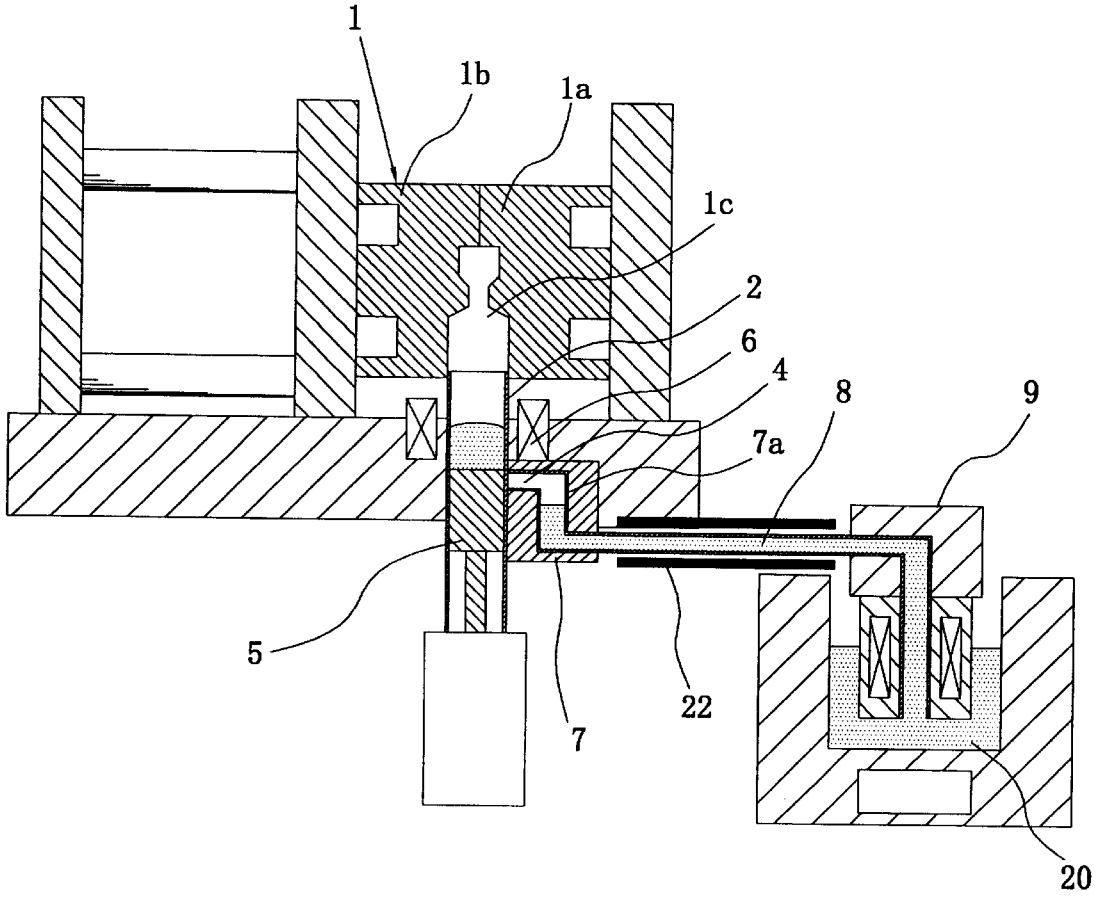
FIG. 1 is a conceptual view showing a die casting apparatus according to a first embodiment of the present invention.

1: die
2: casting sleeve
4: molten-metal feed port
5: plunger tip
6: high frequency coil
7: mouth piece
8: molten-metal feed pipe
12: air cylinder
15: temperature sensor
20: molten metal
22: heater
30: oxide film
31: gas hole

BEST MODE FOR CARRYING OUT THE INVENTION

An embodiment of the present invention will next be described in detail.

In the present invention, in order to substantially granulate primary crystals of molten metal, there can be used a method in which the temperature of molten metal fed to a casting sleeve is set to a temperature near the liquidus line, and in which the temperature of molten metal within the casting sleeve is decreased at a predetermined cooling rate, from the temperature near the liquidus line to a predetermined temperature that is below the liquidus line but higher than the solidus line or eutectic line.

During the process in which the temperature of molten metal within the casting sleeve is decreased from the temperature near the liquidus line to a predetermined temperature that is below the liquidus line but higher than the solidus line or eutectic line, primary crystals of said molten metal are substantially granulated without performance of mechanical agitation or electromagnetic agitation and without application of shearing force in a solid-liquid coexisting state.

In the case of, for example, A356 alloy (having the composition (by weight %) of 6.5–7.5% Si, 0.60% Mg, 0.12% Fe, 0.10% Cu, 0.05% Mn and balance substantially Al) or A357 alloy, the temperature of molten metal is controlled to fall within the range between a temperature that is about 10° C. lower than the liquidus line and a temperature that is about 40° C. higher than the liquidus line. If said molten metal is maintained at a temperature above the above-described range, dendrites grow easily. On the other hand, if said molten metal is maintained at a temperature below the above-described range, dendrites are generated before casting, resulting in deteriorated flowability.

In order to cool molten metal within the casting sleeve in a semi-molten sate to thereby obtain granular primary crystals, said molten metal poured into the sleeve is cooled at a cooling rate within a predetermined range. The cooling rate is preferably set to be less than 10° C./sec. In order to bring the cooling rate within the predetermined range, the casting sleeve is formed into a cold crucible structure, and molten metal is agitated through high frequency agitation, so that heat is applied to said molten metal while the sleeve is cooled. That is, a plurality of electrical conductors are disposed around a material to be cast such that the electrical conductors do not become continuous in the circumferential direction. Alternatively, slits are formed in an electrically conductive material disposed to surround a material accommodated within the casting sleeve. In such a structure, due to electromagnetic induction, current is induced in the electrically conductive portion and the material in a molten or semi-molten state, so that electromagnetic body force generated due to the interaction between the induced current and the magnetic field acts on the molten material in a direction such that the molten material is separated from the surface of the casting sleeve to prevent contact between the material and the casting sleeve. Therefore, a temperature decrease due to such contact between the material and the casting sleeve is small. Thus, molten metal within the sleeve can be soaked, and the crystallized solid phase can be made into a spherical shape.

Further, when molten metal is fed to the casting sleeve, the interior of the casting sleeve is made an inert gas atmosphere in order to establish a state in which the surface of said molten metal is covered with an inert gas. Subsequently, said molten metal is injected into the cavity of a die in order to cast a product. Thus, generation of gas defects can be prevented. In addition, oxidation of said molten metal can be minimized.

For making primary crystals into a spherical shape, there may be employed a method in which molten metal having an ordinary temperature is poured into a casting sleeve, and said molten metal is subjected to electromagnetic agitation in order to make the primary crystals into a spherical shape.

FIGS. 1, 2, 3, 4, 5, and 6, show an embodiment of the die casting apparatus of the present invention.

Figure 2:
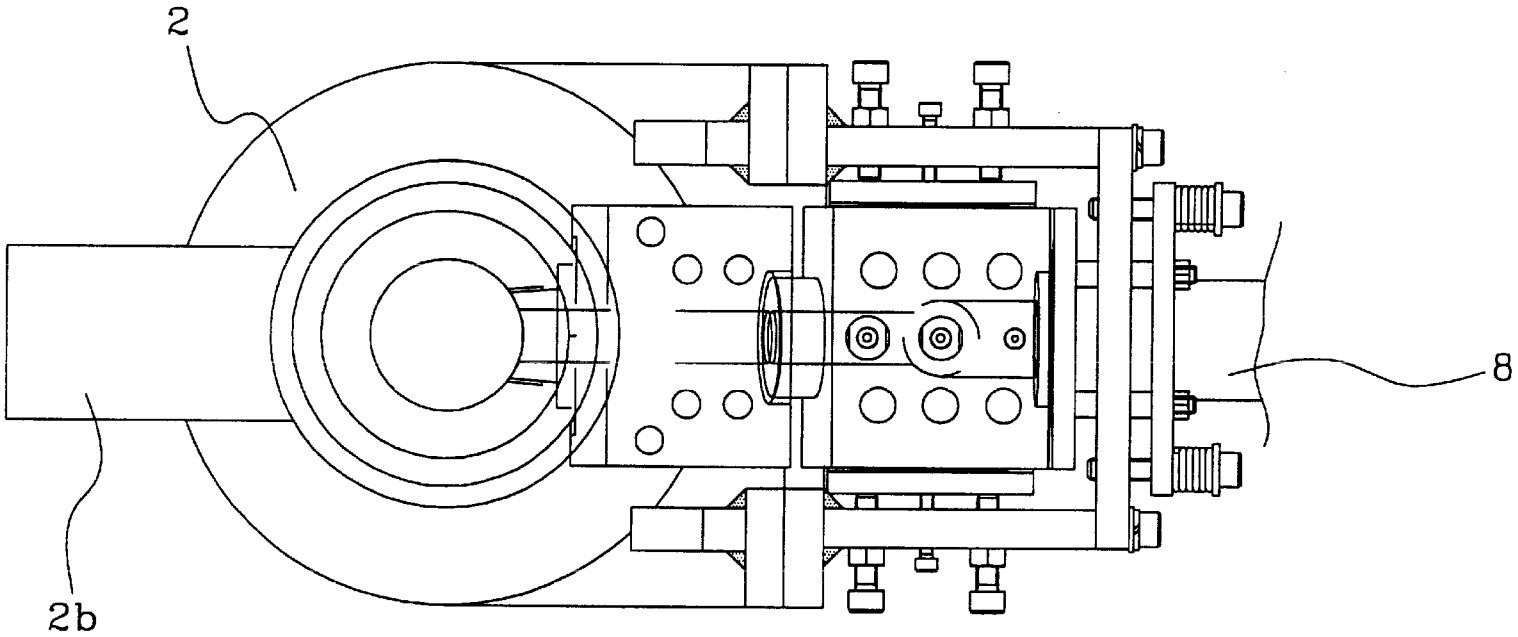
FIG. 2 is a partial plan view of the die casting apparatus according to the first embodiment of the present invention shown in FIG. 1.
Figure 3:
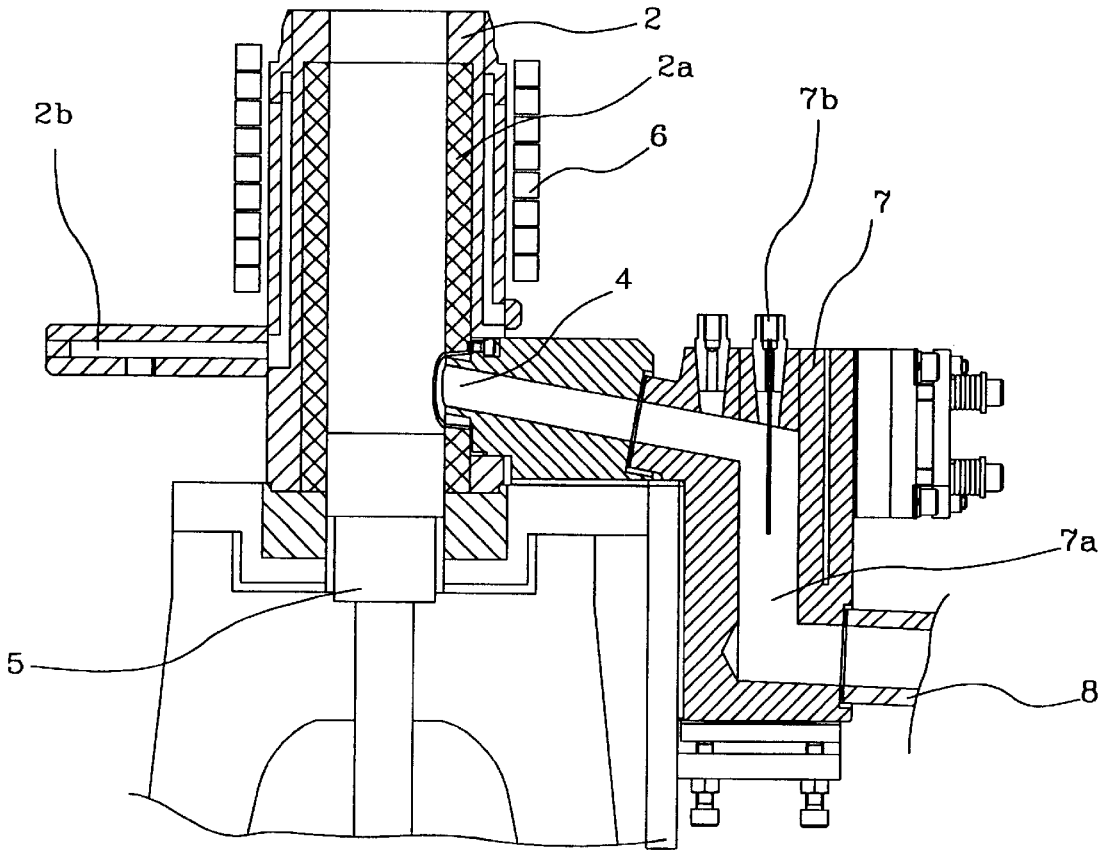
FIG. 3 is a partial sectional view of the die casting apparatus according to the first embodiment of the present invention shown in FIG. 1.

As shown in FIGS. 1, 2, and 3, a die 1 of a vertical injection die casting apparatus is composed of a stationary die 1*a* and a movable die 1*b* and has a structure such that the stationary die 1*a* and the movable die 1*b* are separated from each other in the left/right direction. A casting sleeve 2 has a structure such that its tip end is fitted into a sprue portion 1*c* of the die 1, and an inner tube 2*a* formed of ceramics is fitted onto the inner surface of the casting sleeve 2 that comes into contact with molten aluminum. A molten-metal feed port 4 is formed in a lower side portion of the casting sleeve 2 at a position above a plunger tip 5. A high frequency coil 6 is disposed around the casting sleeve 2 to extend from a point above the molten-metal feed port 4 to the top portion of the casting sleeve 2. A fluid passage 2*b* for cooling purposes is formed within the casting sleeve 2 at a portion corresponding to the position where the high frequency coil 6 is disposed, and a cooling medium such as water or air is passed through the fluid passage 2 for the purpose of cooling.

To the molten-metal feed port 4 is connected a mouthpiece 7 that has a passage whose diameter is equal to that of the molten-metal feed port 4. Further, a molten-metal feed pipe 8 for feeding molten aluminum is connected to a connection opening of the mouth piece 7 provided at the other end thereof. The passage of the mouth piece 7 has a vertical passage portion 7*a* at the central portion of the mouth piece 7. A gas supply port 7*b* is provided above the vertical passage portion 7*a* and a pipe is connected to the gas supply port 7*b*. This structure allows an inert gas such as argon or nitrogen to be supplied into the vertical passage portion 7*a*. A refractory material such as silicon carbide or carbon ceramics may be used as a material that forms the mouth piece 7 and comes into contact with molten metal.

The molten-metal feed pipe 8 communicates with a molten aluminum feeder 9 and an aluminum holding furnace 10. Thus, molten aluminum 20 is fed to the molten-metal feed pipe 8. In general, the level of the molten aluminum 20 is maintained at an arbitrary position along the vertical passage portion of the mouth piece 7. In the present embodiment, the molten aluminum feeder 9 is described as being of an electromagnetic pump scheme. However, a gas-pressurized scheme or another scheme may be used. No limitation is imposed on the molten metal feed scheme.

A sheath heater or cartridge heater 22 is disposed outside the mouth piece 7 and the molten-metal feed pipe 8. Further, heat radiation is prevented through use of a heat insulating material. Thus, solidification of molten aluminum within the molten-metal feed pipe 8 is prevented.

Next, with reference to FIGS. 4, 5, and 6, a description will be given of the steps of the die casting method of the present invention that is performed through use of the above-described die casting apparatus of the present invention. The casting process described below can be performed under control by means of a controller such as a computer.

Figure 4:
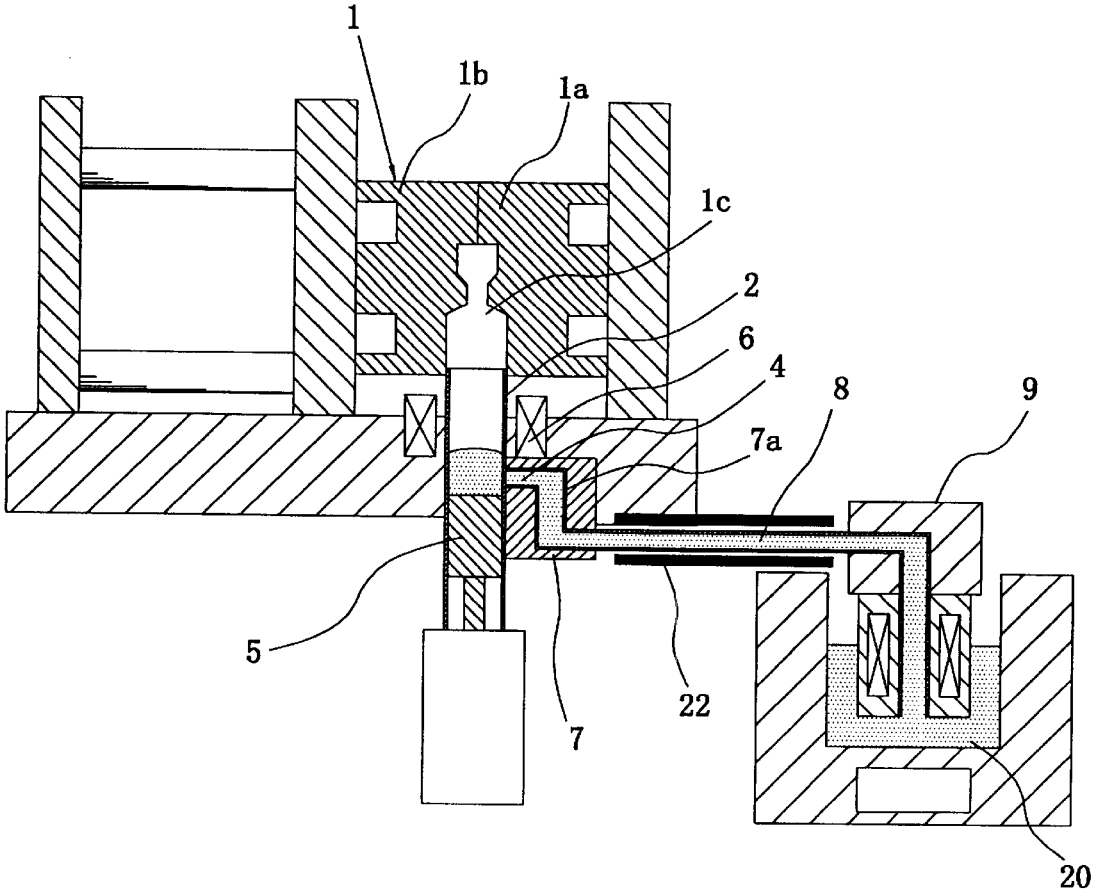
FIG. 4 is an explanatory view showing an operational step of the die casting apparatus according to the first embodiment of the present invention shown in FIG. 1.

As show n in FIG. 4, the molten aluminum feeder starts feed of the molten aluminum 20 to the casting sleeve 2. Via the mouth piece 7 and the molten-metal feed port 4, the molten aluminum flows into the casting sleeve 2 while undergoing laminar flow. When the molten aluminum reaches a predetermined level, the plunger tip 5 is moved upward within the casting sleeve 2 and stops at a position where the side surface of the plunger tip 5 closes the molten-metal feed port 4. Simultaneously, the controller instructs the molten aluminum feeder to return the molten aluminum to the vertical passage portion 7*a* of the mouth piece 7. Further, the stop position of the tip end of the plunger tip 5 is monitor ed by means of an unillustrated sensor that always detects the distance of movement of the plunger tip 5, and the detected position is input to an unillustrated controller to be recognized thereby.

Figure 5:
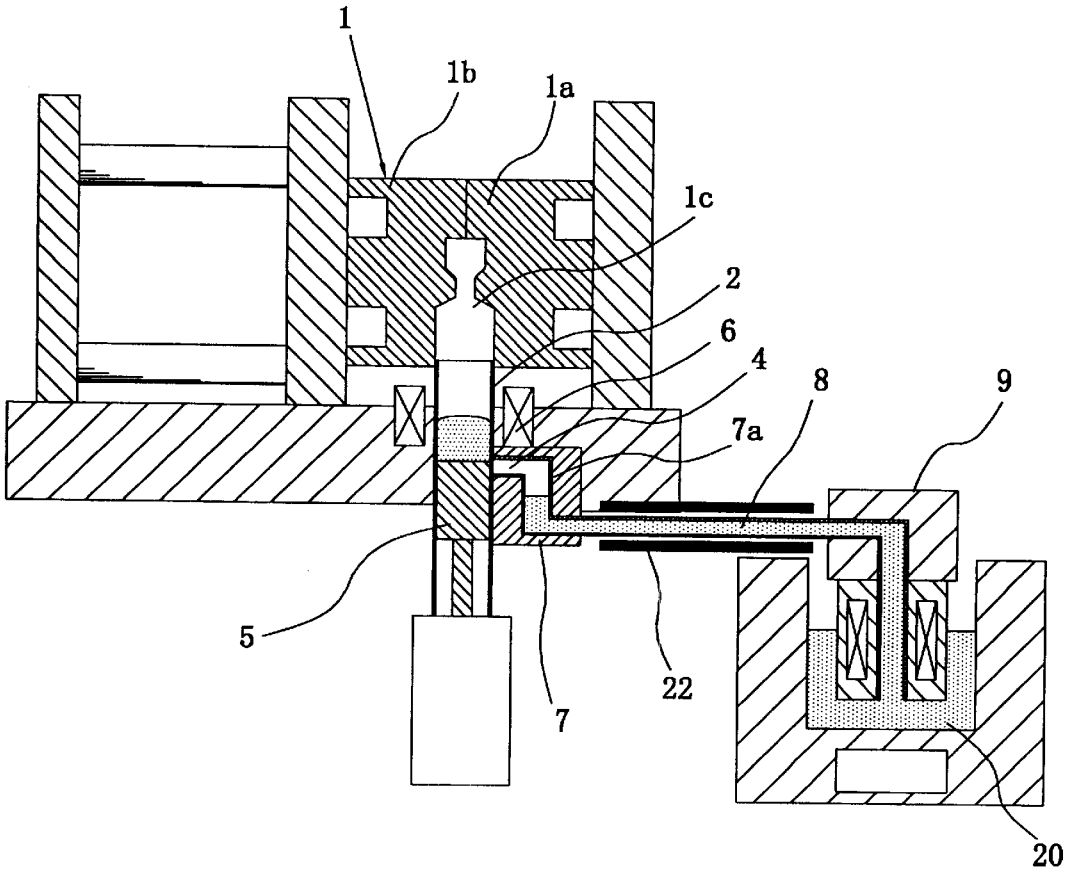
FIG. 5 is an explanatory view showing another operational step of the die casting apparatus according to the first embodiment of the present invention shown in FIG. 1.
Figure 6:
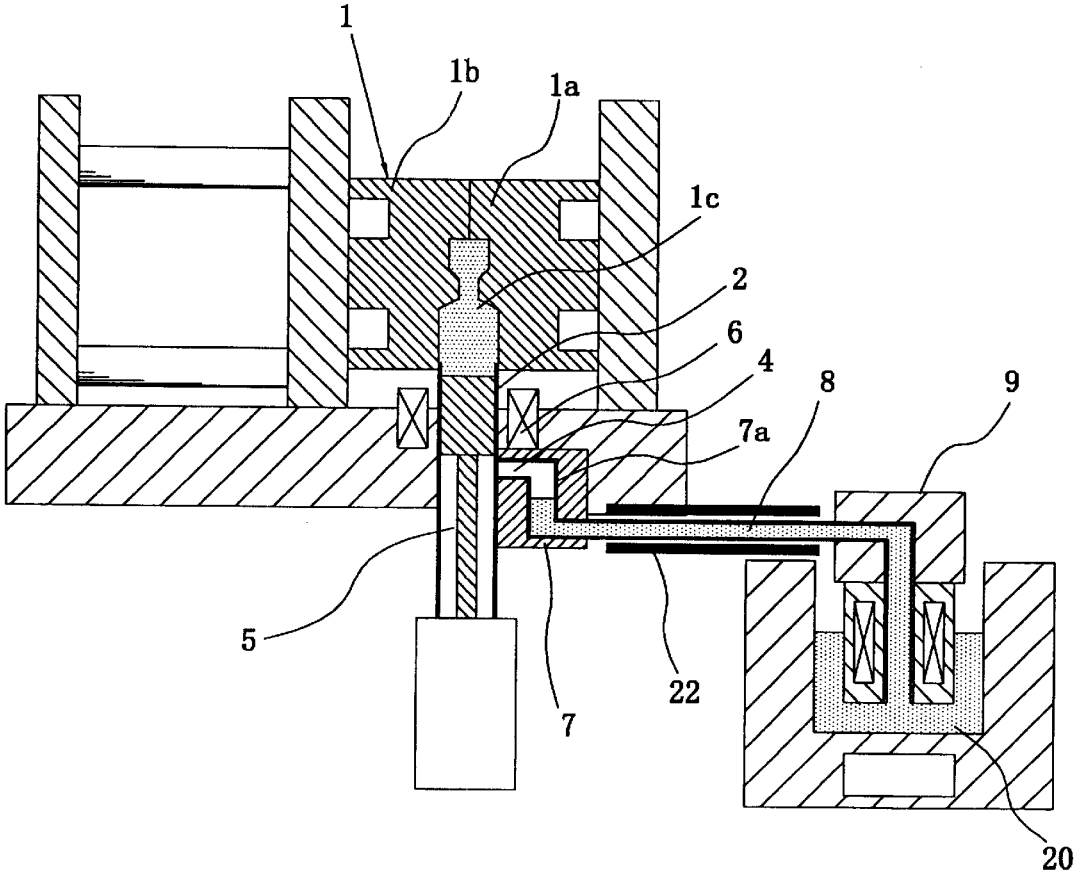
FIG. 6 is an explanatory view showing still another operational step of the die casting apparatus according to the first embodiment of the present invention shown in FIG. 1.

At this time, as shown in FIG. 5, the molten-metal feed port 4 is closed by means of the plunger tip 5. Therefore, when the molten aluminum within the mouth piece 7 moves downward, negative pressure acts on the surface of the molten aluminum. However, since argon or nitrogen is supplied into the mouth piece 7 from the gas supply port 7*b* provided at the upper portion of the mouth piece 7, the negative pressure within the mouth piece 7 is relieved in order to accelerate downward movement of the molten aluminum. In addition, oxidation of the molten aluminum is prevented. Further, through provision of a check valve into the pipe between the gas supply port 7*b* and a gas tank, the molten aluminum can be prevented from flowing from the mouth piece 7 to an area between the gas supply port 7*b* and the gas tank. A filter is preferably disposed at the gas supply port 7*b* in order to prevent a possible reverse flow of molten aluminum and to maintain the pressure within the gas pipe at a proper level.

Molten aluminum that has flowed into the casting sleeve 2 is cooled by means of a cooling medium flowing through passages 2*b* formed within the casting sleeve 2 so that the molten aluminum forms granular primary crystals and reaches a semi-solidified state. Simultaneously, through use of the high frequency coil 6, the molten aluminum within the casting sleeve 2 is subjected to electromagnetic agitation. As a result, the molten aluminum is fluidized and soaked, and simultaneously granular primary crystals become spherical. At this time, the temperature of the molten aluminum is detected by means of an unillustrated temperature sensor. When the computer (also unillustrated) or the like judges that the solid phase ratio of the molten aluminum has reached an arbitrary value in the range of 10–60%, the computer or the like moves the plunger tip 5 upward, as shown in FIG. 6, in order to inject the semi-solidified molten aluminum into the cavity of the die 1.

EXAMPLE 1

Figure 7:
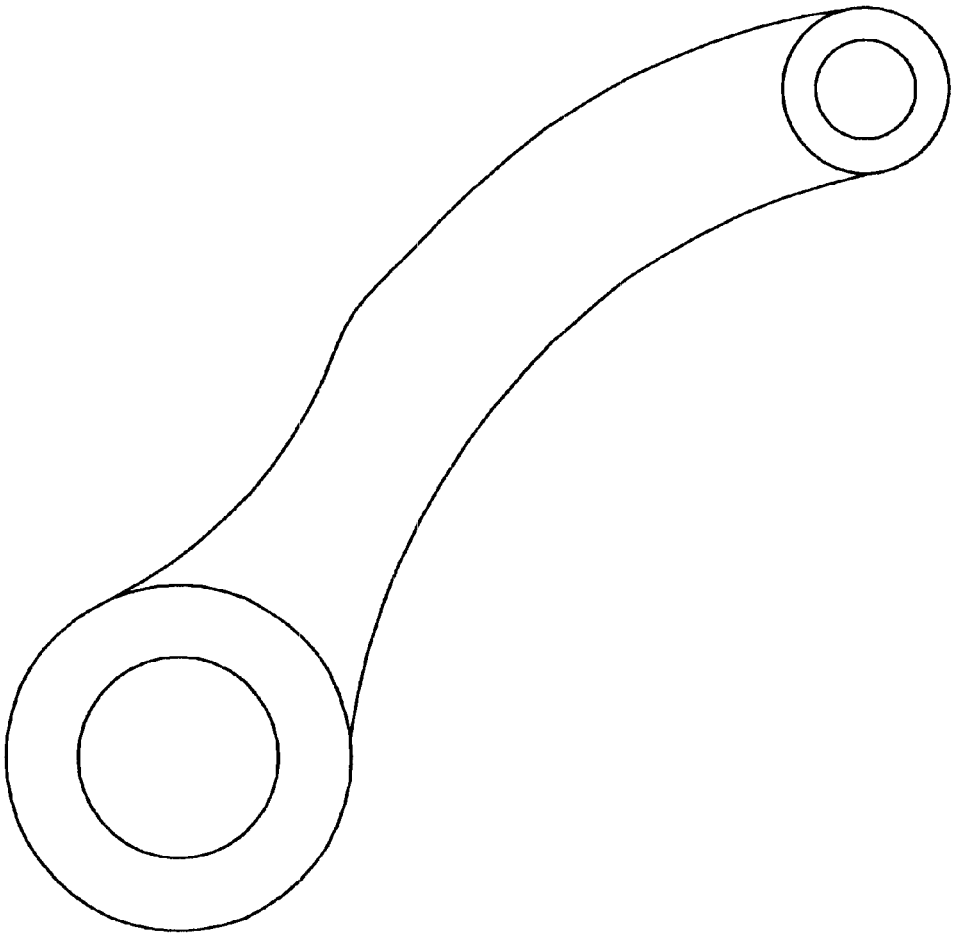
FIG. 7 is an outside view of a casting that was cast through use of JIS AC4CH alloy (having the composition (by weight %) of 7.0% Si, 0.30% Mg, <0.20% Fe, balance substantially Al), and in accordance with the die casting method of the present invention.
Figure 8:
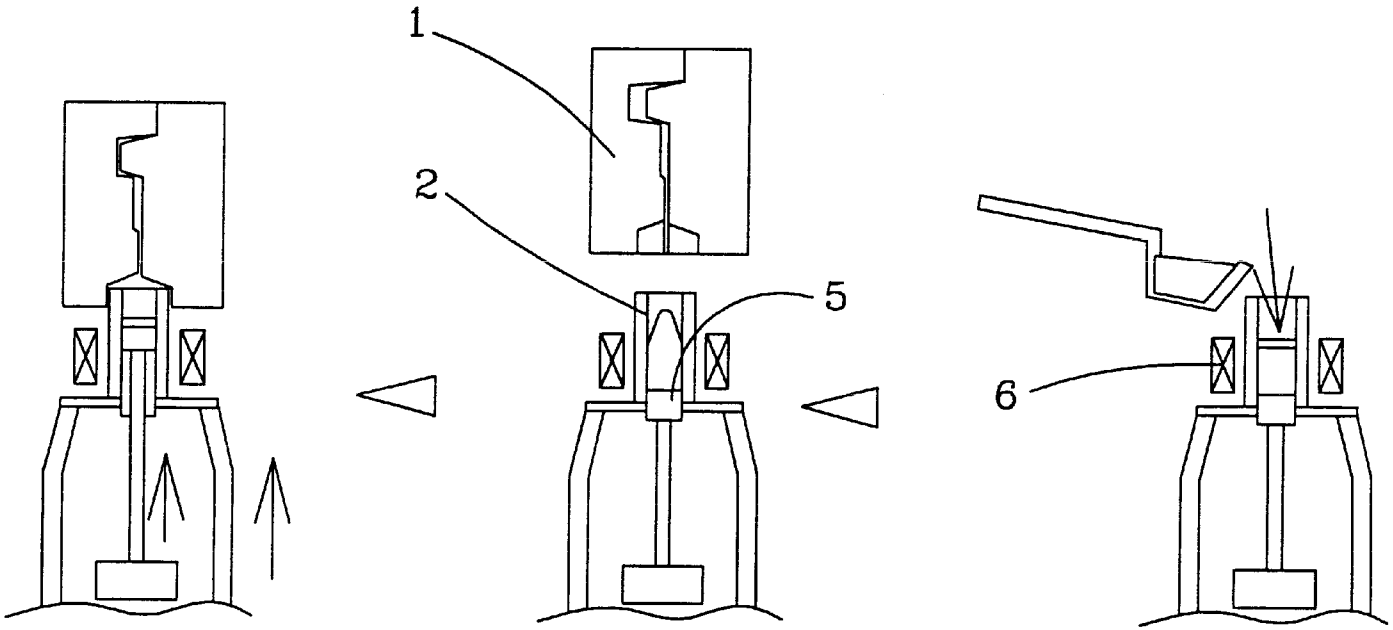
FIG. 8 is an explanatory view showing the steps of conventional die casting.
Figure 9:
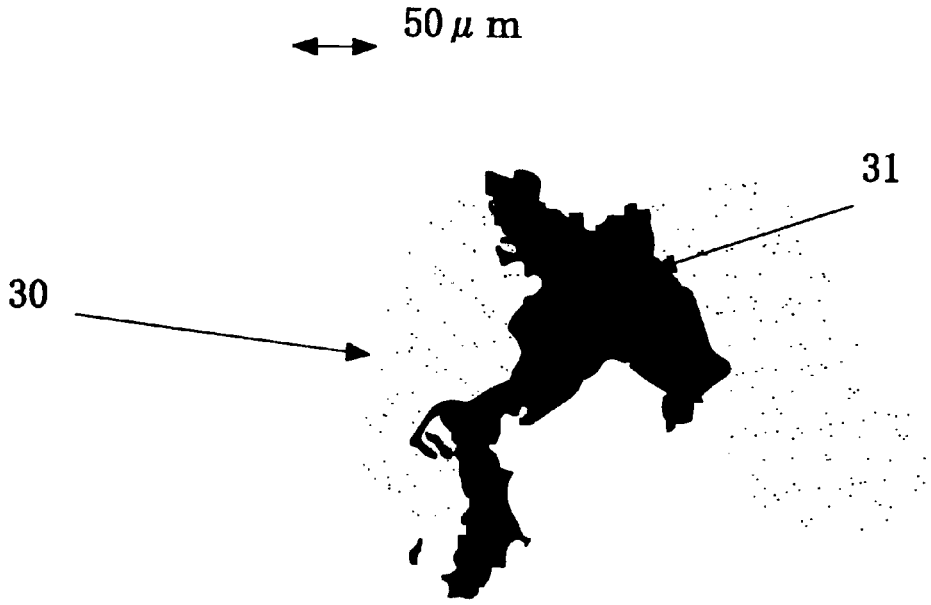
FIG. 9 is an explanatory view showing defects of a product obtained through use of the conventional die casting method.

Through use of the die casting apparatus of the present invention, castings as shown in FIG. 7 were cast from JIS AC4CH alloy in accordance with the die casting method of the present invention. These castings are Examples of the present invention, which are parts of the suspensions for automobiles. Table 1 shows the results of evaluation of Examples and Comparative Examples in terms of mechanical properties. The term "bottom" in the column for "Method of feeding molten metal" in Table 1 indicates the feed method used was the feed method according to the present invention. Specifically, it indicates the case in which molten aluminum was fed from a position near the bottom portion of the sleeve. Similarly, the term "pouring" in the column for "Method of feeding molten metal" in Table 1 indicates the feed method used was the conventional feed method. Specifically, it indicates the case in which molten aluminum was fed from the upper portion of the sleeve. From Table 1, it is understood that by virtue of the present invention, the amount of oxides in castings decreases, and variations in mechanical properties decrease.

With regard to tensile strength ($N/mm_2$), in Examples, the tensile strength varies in the range of 283–286±6–8 $N/mm^2$, which indicates that the variation is about ±6–8 $N/mm^2$. By contrast, in Comparative Examples the tensile strength varies in the range of 283–288±10–11 $N/mm^2$, which indicates that the variation reaches ±10–11 $N/mm^2$, although there is no big difference in the center value. With regard to elongation (%), in Examples the elongation varies in the range of 17.3–19.3±3.3–3.7%, which indicates that the variation is about ±3.3–3.7%. By contrast, in Comparative Examples the elongation varies in the range of 14.8–15.6±5.2–7.2%, which indicates that variation in elongation is apparently larger in the case of Comparative Examples in which the variation reaches about ±5.2–7.2%. In addition, with regard to elongation, there is a big difference between Examples and Comparative Examples in terms of the center values of the variations. That is, in Comparative Examples the center value of elongation varies in the range of 14.8–15.6%, whereas in Examples the center value of elongation varies in the range of 17.3–19.3%. Therefore, the elongation percentage of each of the Examples is larger than those of Comparative Examples, so that Embodiments of the present invention are superior to Comparative Examples in terms of toughness. In consideration of the fact that no big difference exists in tensile strength, it is understood that Embodiments of the present invention are tougher than Comparative Examples.

Further, with regard to gas amount (cc) in 100 g, in Examples the amount of gas contained in castings is 0.5–0.9 (cc/100 g) and in no case exceeds 1.0 cc/100 g, whereas in Comparative Examples the amount of gas contained in castings is 1.0–1.8 (cc/100 g) and in all cases is not less than 1.0 cc/100 g. Accordingly, in Comparative Examples a larger amount of gas is apparently contained in a casting per unit weight.

TABLE 1

| | Method of Feeding Molten Metal | Ar gas | Agitation | Tensile strength ($N/mm^2$) | Elong-ation (%) | Gas amount (cc/100 g) |
|---|---|---|---|---|---|---|
| Example 101 | Bottom | Not supplied | Not performed | 283 ± 8 | 17.3 ± 3.7 | 0.8 |
| Example 102 | Bottom | Supplied | Not performed | 286 ± 6 | 18.1 ± 3.3 | 0.5 |
| Example 103 | Bottom | Not supplied | Performed | 283 ± 6 | 17.4 ± 3.4 | 0.9 |
| Example 104 | Bottom | Supplied | Performed | 283 ± 7 | 19.3 ± 3.5 | 0.6 |
| Compara. Ex. 501 | Pouring | Not supplied | Not performed | 278 ± 11 | 14.8 ± 6.5 | 1.5 |
| Compara. Ex. 502 | Pouring | Supplied | Not performed | 283 ± 10 | 15.3 ± 5.2 | 1.0 |
| Compara. Ex. 501 | Pouring | Not supplied | Performed | 283 ± 10 | 15.6 ± 7.2 | 1.8 |
| Compara. Ex. 502 | Pouring | Supplied | Performed | 283 ± 11 | 15.3 ± 5.9 | 1.1 |

What is claimed is:

1. In a die casting method wherein after molten metal is fed into a casting sleeve through a side portion of the casting sleeve, the molten metal is cooled at a controlled cooling rate of less than 10° C./sec, whereby the molten metal becomes semi-solid, in order to granulate crystallized primary crystals, the die casting method comprising:

feeding the molten metal into the casting sleeve through the side portion of the casting sleeve from the vicinity of the bottom portion of the casting sleeve;

supplying an inert gas near a molten metal feed port into a molten metal feed pipe while the molten metal is in the molten metal feed pipe prior to being fed to the molten metal feed port so that the inert gas prevents oxidation of the molten metal, wherein the molten metal is fed to the molten metal feed port through the molten metal feed pipe and during the method a negative pressure acts on the molten metal in the molten metal feed pipe to inhibit downward movement of the molten metal, but wherein the negative pressure is relieved by the supplying of the inert gas, the molten metal being in a laminar flow state in the molten metal feed pipe, the molten metal feed port and in the casting sleeve; and controlling the amount of gas in the die casting so that the total amount of gas contained in the die casting does not exceed about 1 cc/100 g.

2. A die casting method according to claim 1, characterized in that the interior of the casting sleeve is made to contain an inert gas atmosphere at least when the molten metal is fed into the casting sleeve.

3. A die casting method according to claim 1, wherein the controlled cooling rate is greater than 1.7 to less than 10° C./sec.

4. A die casting method as in claim 1, wherein the total amount of gas in the die casting is 0.5–0.9 cc/100 g.

5. In a die casting method wherein after molten metal is fed into a casting sleeve through a side portion of the casting sleeve, the molten metal is cooled at a controlled cooling rate of less than 10° C./sec, whereby the molten metal becomes semi-solid, in order to granulate crystallized primary crystals, the die casting method comprising:

feeding the molten metal into the casting sleeve through a portion of the casting sleeve which is offset from a center line running along a length of the casting sleeve, which portion of the casting sleeve is between a rest position of a plunger tip disposed within the casting sleeve and a die disposed remote the plunger tip in the following sequence: the die, the portion of the casting sleeve which is offset from the center line; the rest portion of the plunger tip, and further wherein an inert gas is supplied near a molten metal feed port into a molten metal feed pipe while the molten metal is in the molten metal feed pipe prior to being fed to the molten metal feed port so that the inert gas prevents oxidation of the molten metal, wherein the molten metal is fed to the molten metal feed port through the molten metal feed pipe and during the method a negative pressure acts on the molten metal in the molten metal feed pipe to inhibit downward movement of the molten metal, but wherein the negative pressure is relieved by the supplying of the inert gas, the molten metal being in a laminar flow state in the molten metal feed pipe, the molten metal feed port and in the casting sleeve; and controlling the amount of gas in the die casting so that the total amount of gas contained in the die casting does not exceed about 1 cc/100 g.

6. A die casting method according to claim 2, characterized in that the interior of the casting sleeve is made to contain an inert gas atmosphere at least when the molten metal is fed into the casting sleeve.

7. A die casting method according to claim 5, wherein the controlled cooling rate is greater than 1.7 to less than 10° C./sec.

8. A die casting method according to claim 5, wherein the plunger tip is moveable within the casting sleeve at least from the rest position of the plunger tip to the portion of the casting sleeve which is offset from the center line.

9. A die casting method as in claim 5, wherein the total amount of gas in the die casting is 0.5–0.9 cc/100 g.

10. A die casting produced by a process where after molten metal is fed into a casting sleeve through a side portion of the casting sleeve, the molten metal is cooled at a controlled cooling rate of less than 10° C./sec, whereby the molten metal becomes semi-solid, to granulate crystallized primary crystals, wherein the die casting is obtained by:

feeding the molten metal into the casting sleeve through a side portion of the casting sleeve from the vicinity of a bottom portion of the casting sleeve, supplying an inert gas near a molten metal feed port into a molten metal feed pipe while the molten metal is in the molten metal feed pipe prior to being fed to the molten metal feed port so that the inert gas prevents oxidation of the molten metal, wherein the molten metal is fed to the molten metal feed port through the molten metal feed pipe and during the method a negative pressure acts on the molten metal in the molten metal feed pipe to inhibit downward movement of the molten metal, but wherein the negative pressure is relieved by the supplying of the inert gas, the molten metal being in a laminar flow state in the molten metal feed pipe, the molten metal feed port and in the casting sleeve; and controlling the amount of gas in the die casting so that the total amount of gas contained in the die casting does not exceed about 1 cc/100 g.

11. A die casting according to claim 10, wherein total amount of gas in the die casting is 0.5–0.9 cc/100 g.

12. A die casting according to claim 10 wherein the controlled cooling rate is greater than 1.7 to less than 10° C./sec.

13. A die casting produced by a process where after molten metal is fed into the casting sleeve through a side portion of the casting sleeve, the molten metal is cooled at a controlled cooling rate of less than 10° C./sec, whereby the molten metal becomes semi-solid, to granulate crystallized primary crystals, wherein the die casting is obtained by:

feeding the molten metal into the casting sleeve through a portion of the casting sleeve which is offset from a center line running along a length of the casting sleeve, which portion of the casting sleeve is between a rest position of a plunger tip disposed within the casting sleeve and a die disposed remote the plunger tip in the following sequence; the die, the portion of the casting sleeve which is offset from the center line; the rest portion of the plunger tip;

supplying an inert gas near a molten metal feed pipe while the molten metal is in the molten metal feed pipe prior to being fed to a molten metal feed port so that the inert gas prevents oxidation of the molten metal, wherein the molten metal is fed to the molten metal feed port through the molten metal feed pipe and during the method a negative pressure acts on the molten metal in the molten metal feed pipe to inhibit downward movement of the molten metal, but wherein the negative pressure is relieved by the supply of the inert gas, and wherein the molten metal undergoes laminar flow in the molten metal feed pipe, the molten metal feed port and in the casting sleeve; and controlling the amount of gas in the die casting so that the total amount of gas contained in the die casting does not exceed about 1 cc/100 g.

14. A Die casting according to claim 13, wherein the plunger tip is moveable within the casting sleeve at least from the rest position of the plunger tip to the portion of the casting sleeve which is offset from the center line.

15. A die casting according to claim 13, wherein total amount of gas in the die casting is 0.5–0.9 cc/100 g.

16. A die casting according to claim 13 wherein the controlled cooling rate is greater than 1.7 to less than 10° C./sec.

* * * * *